US005210523A

United States Patent [19]

Tipping

[11] Patent Number: 5,210,523

[45] Date of Patent: May 11, 1993

[54] NOISE SUPPRESSION SYSTEM AND METHOD

[75] Inventor: David Tipping, Northford, Conn.

[73] Assignee: Fire-Lite Alarms, Inc., Northford, Conn.

[21] Appl. No.: 661,871

[22] Filed: Feb. 27, 1991

[51] Int. Cl.[5] ..... G08B 17/06; G08B 25/00

[52] U.S. Cl. ..... 340/540; 333/12; 340/524; 340/533; 340/587

[58] Field of Search ..... 340/507, 533, 501, 540, 340/524, 525; 333/12; 336/220, 181, 171

[56] References Cited

U.S. PATENT DOCUMENTS

| | | | |
|---|---|---|---|
| 3,209,342 | 9/1965 | Ward | 340/525 |
| 3,778,759 | 12/1973 | Carroll | 333/12 |
| 4,259,705 | 3/1981 | Stifter | 333/12 |
| 4,754,262 | 6/1988 | Hackett et al. | 340/525 |
| 4,871,999 | 10/1989 | Ishii et al. | 340/587 |
| 5,083,101 | 1/1992 | Frederick | 333/12 |
| 5,113,159 | 5/1992 | Andriaenssens et al. | 333/12 |

*Primary Examiner*—Glen Swann, III

*Attorney, Agent, or Firm*—Dressler, Goldsmith, Shore, Sutker & Milnamow, Ltd.

[57] ABSTRACT

A broadband transformer with one-to-one turns ratio provides common mode noise suppression in a transmission line. One winding of the transformer is connected in series with each of the two wires of the transmission line. The transmission line is connected between a multiplexer device, coupled in turn to a plurality of spaced-apart fire detectors, and an output fire alarm control panel. Common mode noise on the transmission line results in only a very small noise current appearing at the central fire alarm panel. As a result, a noise rejection for the system is increased.

8 Claims, 5 Drawing Sheets

NOISE SUPPRESSION SYSTEM AND METHOD

FIELD OF THE INVENTION

The invention pertains to noise suppression devices. More particularly, the invention pertains to noise suppressing devices usable to minimize common mode noise on low cost transmission lines.

BACKGROUND OF THE INVENTION

Various types of fire detection systems are known in the prior art. Such systems often include a plurality of detectors spaced-apart from one another and located in a region for which protection is to be provided. The detectors are coupled, via transmission lines of one type or another, to multiplexing circuitry and/or then to central fire control panels. The fire control panels in large buildings are usually monitored 24 hours a day and provide visual and/or audible indications of the existence of an alarm condition as well as the general location in the region being monitored.

Many pre-existing fire alarm systems have been wired using non-twisted pair or non-shielded wire. Earlier known systems, particularly those which are analog systems, have provided very reasonable levels of noise immunity without using twisted pair or shielded wire. Newer systems very often use higher frequency digital transmission protocols which are more susceptible to noise. One such system is disclosed in Tice et al. U.S. Pat. No. 4,916,432 assigned to Pittway Corporation.

In the prior art, devices have been used which can distinguish between valid electrical signals and unwanted noise by sensing the durations of the respective signals. However, noise impulses which are approximately the same duration as a valid electrical signal often, with prior art products, cannot be distinguished from the valid signal. Hence, the noise which cannot be distinguished, can result in altering an otherwise valid transmission or perhaps creating a false alarm condition.

One approach to minimizing noise problems of transmission lines is to use twisted pair or shielded transmission cables. However, twisted pair or shielded wire is more expensive than non-twisted or non-shielded wire.

In addition to the higher cost of higher performance transmission line cabling, it would be very desirable to be able to use the existing non-twisted pair, non-shielded wire in upgrading existing systems to higher performance levels. Thus, substantial commercial advantages can be obtained by being able to use existing non-twisted pair, non-shielded wire in combination with state-of-the-art high speed digital transmission systems while at the same time providing enhanced noise immunity.

SUMMARY OF THE INVENTION

A low noise fire detection system includes a central control panel, as well as one or more fire detection units, which are displaced from the control panel. A pair of conductors form a transmission line coupled between the control panel and the fire detectors.

A first winding of a noise suppressing unit is coupled in series with one of the conductors. A second winding of the noise suppressing unit is coupled in series with the second conductor and also inductively coupled to the first winding. The windings are phased so that like polarities are connected to the control panel. As a result, common mode noise coupled to the conductors is substantially minimized or cancelled.

Conversely, differential electrical currents which are impressed onto the first and second conductors of the transmission line effectively produce cancelling magnetic fields which result in a very small effect on the desired differential signal current. At the same time, the common mode noise current is substantially reduced.

A noise suppressor in accordance with the present invention includes a transformer which can be wound on a toroidal magnetic core. The turns ratio for the two windings on the core is one-to-one. Preferably, the transformer will have a bandwidth such that it does not represent a significant impedance with respect to relatively high speed differential currents.

A method of suppressing, low noise in a pair of conductors of a transmission line includes the steps of generating a first voltage in one line which corresponds to a common mode noise signal coupled thereto, generating a second voltage in the second line which corresponds to the same coupled common mode signal and cancelling the two generated voltages thereby minimizing common mode noise current in the transmission line. The method can also include generating a differential electrical current in the pair of conductors simultaneously while suppressing or cancelling the common mode noise current.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
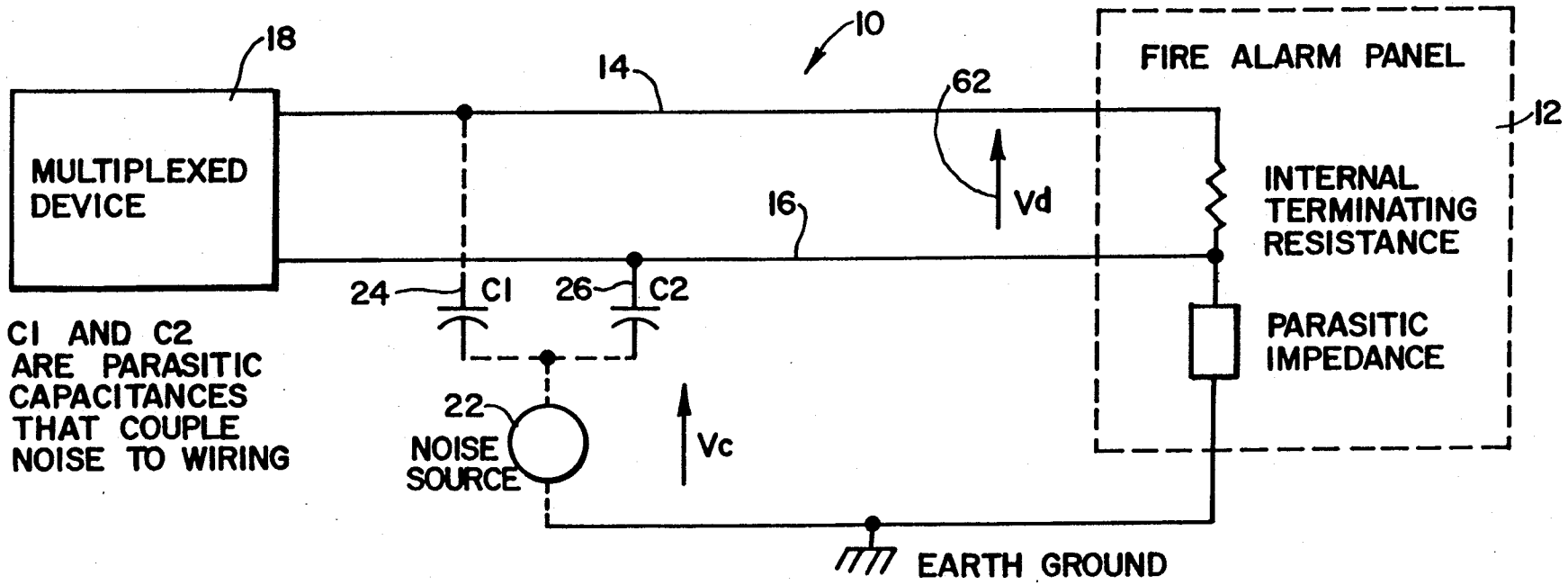
Fig. 1 PRIOR ART
FIG. 1 illustrates schematically, a portion of a prior art fire alarm system.

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

FIG. 1 illustrates a prior art system 10 which includes a central fire alarm control panel 12 which is coupled by first and second conductors 14 and 16 to a remote multiplexing device 18. Such devices are known in the prior art for the purpose of combining signals from a group of displaced fire or combustion detectors.

Conductors 14 and 16 which have been used in prior art systems, such as a system 10, have often been non-twisted pairs or non-shielded cable. Such transmission lines are susceptible to common mode noise from an external source such as a source 22.

Common mode noise from the source 22 is coupled via parasitic capacitors 24 and 26 to the lines 14 and 16 respectively. Noise $V_c$ from the source 22 thus generates unwanted voltage and current spikes on the lines 14 and 16.

Figure 2:
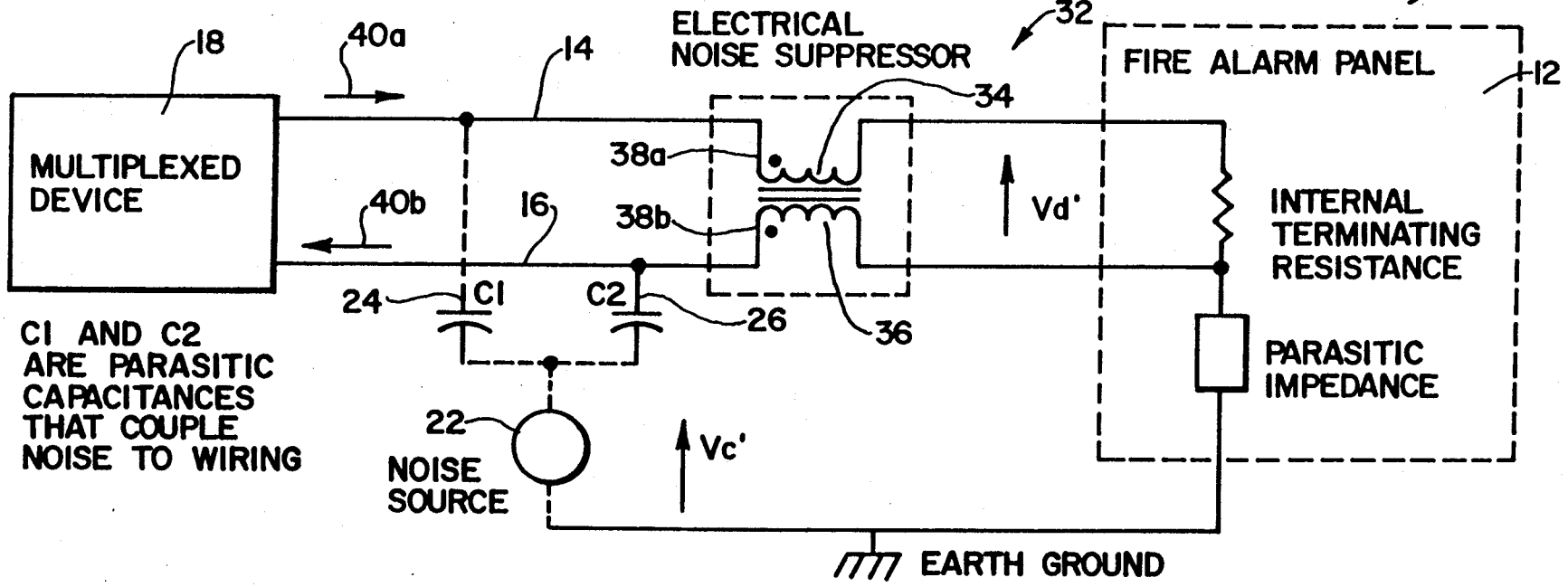
FIG. 2 illustrates schematically, a portion of a fire alarm system in accordance with the present invention.

FIG. 2 illustrates a system 30 in accordance with the present invention. Elements in FIG. 2 which previously appeared in the system 10 of FIG. 1 have been given the same identification numerals in FIG. 2. The system 30 includes an electrical noise suppressing element 32, which can be implemented as a transformer, which has first and second inductively coupled coils 34 and 36. The noise suppressing transformer 32 is connected with coil 24 in series with the conductor 14 and coil 36 in series with the conductor 16.

Coils 34 and 36 of the transformer 32 are phased so that like polarities are connected to the fire alarm panel 12. The dots 38*a* and 38*b* located adjacent to the coils 34 and 36 respectively indicate polarity as is conventional for transformers.

Preferably, the coils 34 and 36 have a one-to-one turns ratio. The affect of using the transformer 32 connected into the lines 14 and 16 as illustrated in FIG. 2 is to cancel out common mode currents induced by noise source 22. Because the coils of the transformer 32 are connected into the lines 14 and 16, as illustrated in FIG. 2, induced voltages which appear in coils 34 and 36, generated by a noise source 22 oppose one another and as a result induced common mode noise currents are cancelled out.

Conversely, electrical signals intentionally impressed on the lines 14 and 16 by either the panel 12 or the multiplex device 18 impress a differential mode current indicated as 40*a* and 40*b* on the lines 14 and 16 respectively. The induced voltages associated therewith have opposite polarities and do not cancel as in the previously described case with respect to induced common mode noise. The result is thus a minimal effect on the differential signal current 40*a* and 40*b*. On the other hand, the induced current due to the common mode noise is substantially reduced.

Figure 3:
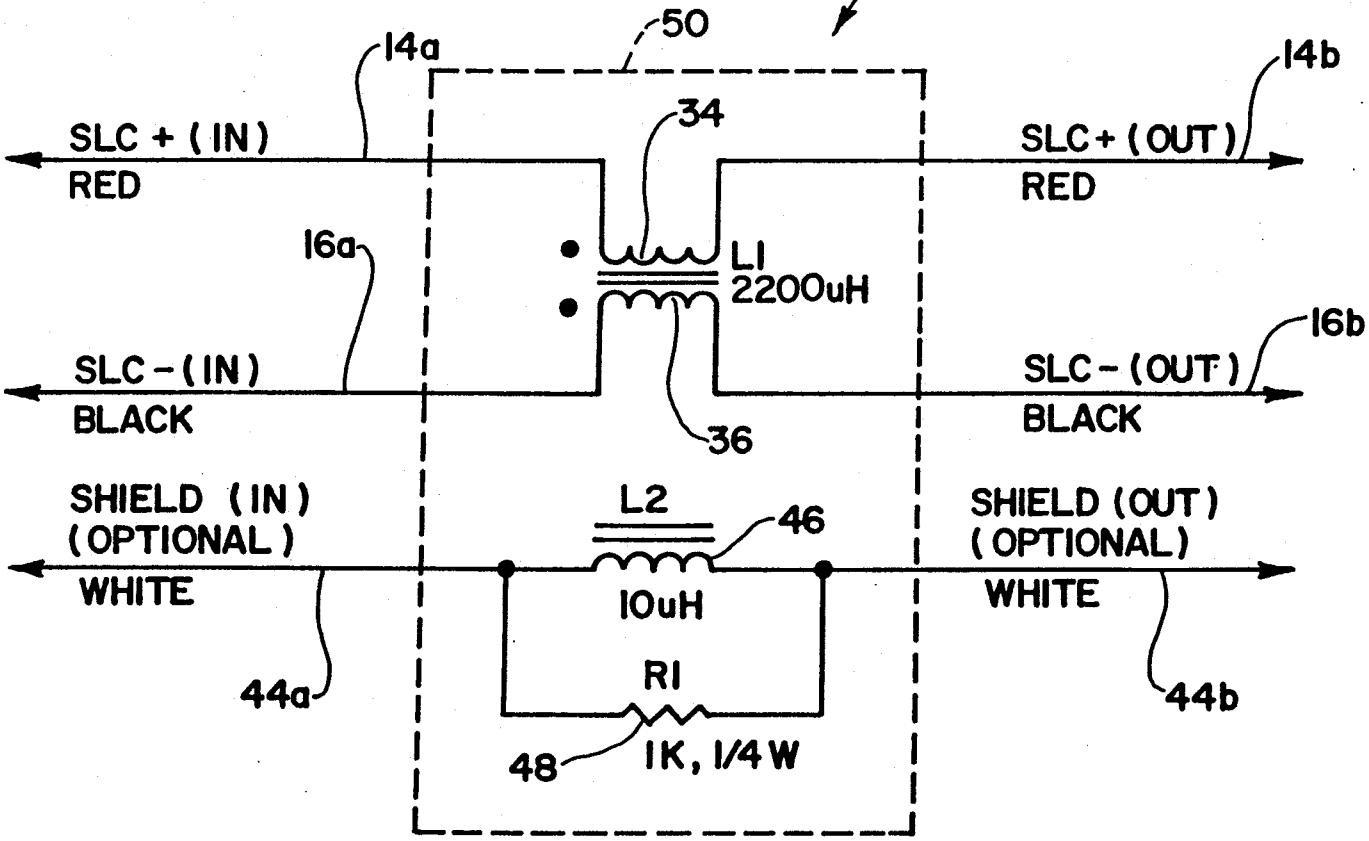
FIG. 3 illustrates schematically, the structure of a noise suppressing element usable in the system of FIG. 2.

FIG. 3 illustrates schematically an alternate noise suppressing unit 42 which includes additional connections 44*a* and 44*b* to and from an associated electrical shield. Associated with connections 44*a* and 44*b* are an additional noise suppressing inductor 46 and parallel resistor 48. The unit 42 can be contained within a housing 50.

Figure 4:
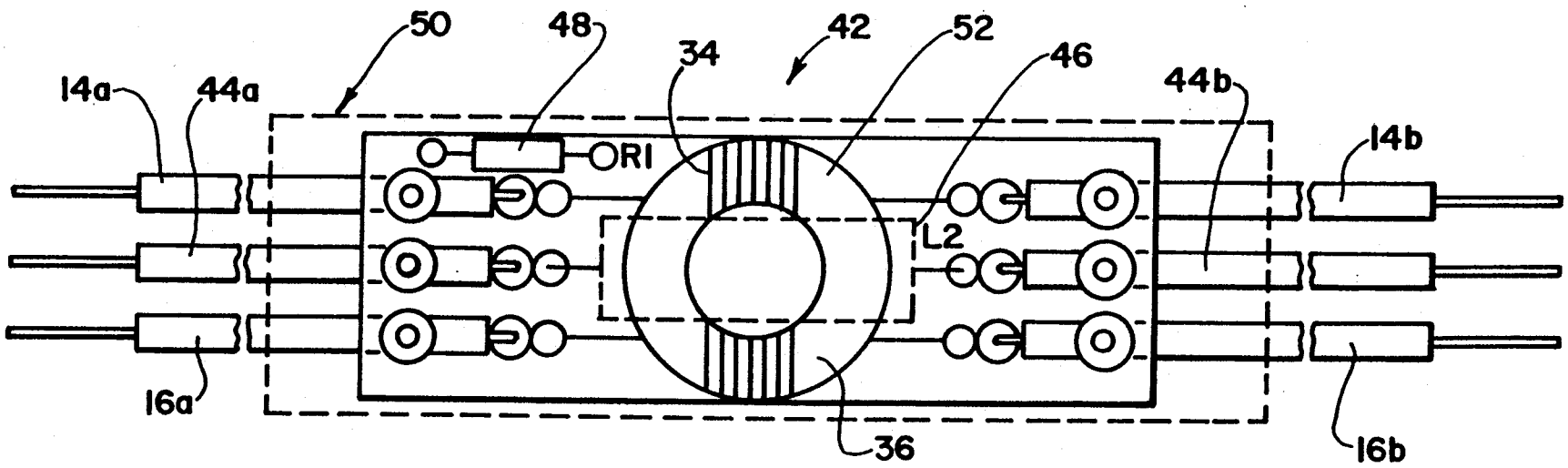
FIG. 4 is a mechanical diagram of an element in accordance with FIG. 3.

FIG. 4 illustrates the physical structure of the unit 42 including a toroidal magnetic core 52 contained within the housing 50 and upon which the windings 34 and 36 are formed.

The inductance of the coils 34 and 36 can be on the order of 2200 microhenries. The inductance of the coil 46 can be on the order of 10 microhenries. The value of resistor 48 can be on the order of 1,000 ohms.

FIG. 4 is a graph illustrating the increase in common mode rejection ratio (CMRR) contributed by a noise suppressor such as 32 or 42.

The graph of FIG. 4 was generated by making measurements on a system such as the system 10 and such as the system 30. The noise source 22 was replaced by a sine ave generator which was coupled to the conductors 14 and 16 via capacitors 24 and 26.

Initially, the common mode rejection ratio of the system 10 was measured utilizing the noted sine wave generator. The resultant and differential voltages labeled $V_c$ and $V_d$ in FIG. 1, was then measured. The common mode rejection ratio for system 10 was then calculated as a function of frequency using the following equation:

$$\text{CMRR} = 20 \log (V_d/V_c)$$

Similarly measurements were then made with respect to the system 30 and the common mode rejection ratio thereof was calculated using the following equation:

$$\text{CMRR}' = 20 \log (V_d'/V_c')$$

The improvement in common mode rejection ratio was determined by subtracting the results for CMRR' from CMRR resulting in the following equation:

$$\text{CMRR}' - \text{CMRR} = 20 \log (V_c'V_c)$$

for $V'_d = V_d$ $\text{CMRR}' - \text{CMRR} = 20 \log (V_c'/V_c)$

Figure 5:
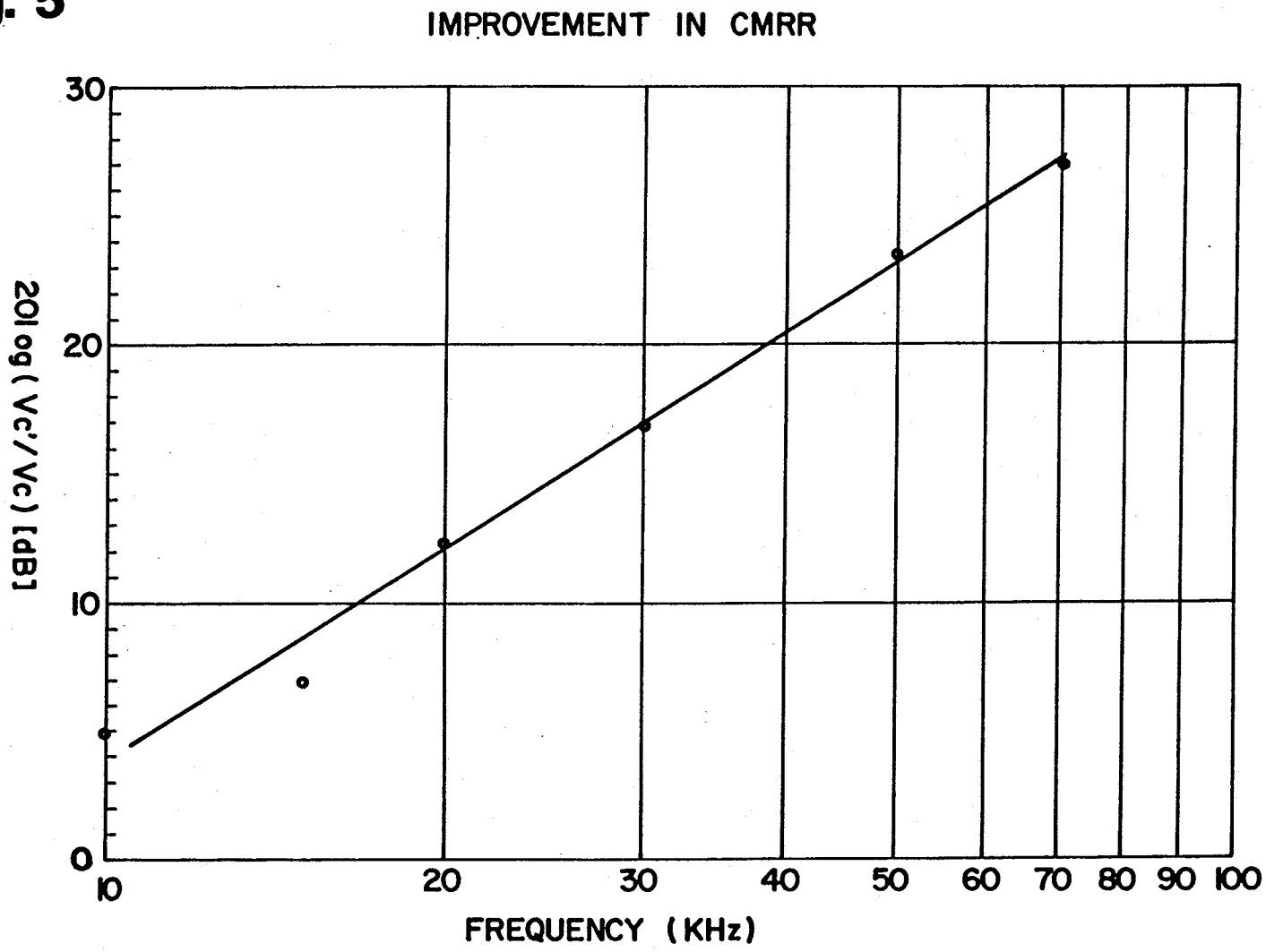
FIG. 5 is a plot of improvement in common mode rejection characteristics verses frequency of a system in accordance with the present invention.

The results of these measurements as a function of frequency are illustrated in FIG. 5.

Improvement in CMRR shown on FIG. 5 was measured on AM2020 fire alarm panel in presence of duplex communication. The readings were taken with use of oscilloscope.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. A low noise fire detection system comprising:
a control panel with first and second input terminals;
a fire detection apparatus displaced from said control panel;
first and second elongated conductors coupled between said panel and said apparatus;
a filter to reduce common mode noise signals wherein said filter is interposed between said conductors and said panel, said filter including:
a first inductive element coupled is series between said first conductor and said first input terminal;
a second inductive element coupled in series between said second conductor and said second input terminal with said elements inductively coupled together and oriented to substantially cancel electrical common mode noise signals but not differential mode signals appearing simultaneously in both of said conductors.

2. A system as in claim 1 with said inductive elements carried on a common coupling member.

3. A system as in claim 1 including a toroidal magnetizable core with said elements coupled thereto.

4. A system as in claim 3 wherein said elements are wound, at least in part, about said core spaced apart from one another.

5. A system as in claim 3 with said inductive elements having a one-to-one turns ratio.

6. A filter, usable in an alarm system which includes:
a control unit with a two terminal input port;
an elongated conductor pair, wherein the conductor pair is susceptible to common mode noise, and wherein the pair has first and second ends;

a plurality of detector units coupled to the conductor pair; and the filter comprising:

a housing;

a toroidal magnetic core carried within said housing;

first and second windings on said core, wherein said windings have a unity turns ratio, wherein said windings can be coupled between the first ends of the conductor pair an the two terminal input port of the control unit adjacent thereto, and wherein said windings are wound to substantially cancel common mode signals induced in the conductor pair but not differential mode signals of approximately the same duration.

7. A filter as in claim 6 wherein said core and said coils in combination have a bandwidth such that differential mode signals on the conductor pair over a range of at least 20–40 KHz are not blocked form the input port.

8. A filter as in claim 6 wherein an inductance parameter of each of said coils is on the order of 2200 microhenries.

* * * * *